US006777874B2

(12) United States Patent
Nakatani et al.

(10) Patent No.: US 6,777,874 B2
(45) Date of Patent: Aug. 17, 2004

(54) PLASMA DISPLAY PANEL HAVING UNIFORM SPACE BETWEEN SUBSTRATES

(75) Inventors: Tomoyuki Nakatani, Yamanashi (JP); Sota Okamoto, Yamanashi (JP)

(73) Assignees: Pioneer Corporation, Tokyo (JP); Pioneer Display Products Corporation, Shizuoka (JP)

( * ) Notice: Subject to any disclaimer, the term of this patent is extended or adjusted under 35 U.S.C. 154(b) by 0 days.

(21) Appl. No.: 10/285,428

(22) Filed: Nov. 1, 2002

(65) Prior Publication Data

US 2003/0137245 A1 Jul. 24, 2003

(30) Foreign Application Priority Data

Jan. 24, 2002 (JP) ..... P2002-015965

(51) Int. Cl.[7] ..... H01J 17/49
(52) U.S. Cl. ..... 313/586; 313/582
(58) Field of Search ..... 313/582–587, 313/493; 445/24, 42, 43

(56) References Cited

U.S. PATENT DOCUMENTS 6,414,434 B1 * 7/2002 Nakano et al. ..... 313/582

* cited by examiner

*Primary Examiner*—Joseph Williams
(74) *Attorney, Agent, or Firm*—Sughrue Mion, PLLC

(57) ABSTRACT

A plasma display panel 10 includes a front substrate 11 and a back substrate 17 facing each other with a discharge space held therebetween, the surrounding areas of the substrates 11 and 17 being sealed up with a sealing layer 23, and partition walls 21 for sectioning the discharge space in a display area 31 into a plurality of discharge spaces. An exhaust/lead-in port 25 for exhausting and introducing discharge gas from and into the discharge spaces is provided in the outer peripheral non-display area 32 of one of the front and back substrates 11 and 17 and a lead-in rib 24 for defining a lead-in passage 41 from the exhaust/lead-in port 25 is provided. The dimension 42*a* of the space between the front substrate 11 and the back substrate 17 in the portion provided with the sealing layer 23 and the lead-in rib 24 is uniformized.

9 Claims, 4 Drawing Sheets

PLASMA DISPLAY PANEL HAVING UNIFORM SPACE BETWEEN SUBSTRATES

BACKGROUND OF THE INVENTION

1. Field of the Invention

The present invention relates to a plasma display panel and more particularly to a plasma display panel having a pair of substrates facing each other with a discharge space held therebetween, the surrounding areas of the substrates being sealed up with sealing material.

2. Description of the Related Art

A typical conventional plasma display panel (PDP) is provided with a plurality of discharge spaces formed by sectioning an airtight space between a pair of substrates, in a striped or matrix form and selectively causing an electric discharge in the plurality of discharge spaces whereby to display an image.

The structure of a conventional plasma display panel will be described by reference to FIGS. 1, 2 and 4.

FIG. 1 is a plan view of the plasma display panel; FIG. 2 is a partial sectional view taken on line V—V of FIG. 1; and FIG. 4 is a partial sectional view depicting characteristic of the conventional plasma display panel taken on line W—W of FIG. 1.

As shown in FIGS. 1, 2 and 4, a conventional plasma display panel 20 has transparent electrodes 12 laid on the inner surface of a front substrate 11 and narrow bus electrodes 13 laid on the respective transparent electrodes 12; further, line electrode pairs (display electrodes) 14 forming display lines, a dielectric layer 15 for covering the line electrode pairs 14, and an MgO layer 16 are provided thereon in this order.

On the other hand, on the inner surface of a back substrate 17 facing the front substrate 11 via the discharge spaces lie column electrodes 18 as discharge cells formed in a direction perpendicular to the line electrode pairs 14 and in the intersecting portions with the respective line electrode pairs 14, a column electrode protective layer (white dielectric layer) 19 for covering the column electrodes 18, partition walls 21 for use in sectioning the space between the two substrates into the discharge spaces on a discharge cell-basis, and phosphor layers 22 of R, G and B colors for covering the side wall of the column electrode protective layer 19 between the partition walls and the side walls of each partition wall 21.

A discharge gas containing neon and xenon gases is encapsulated in the discharge spaces. Each partition wall 21 is provided between the column electrodes to form striped partition walls 21 such that the space between the two substrates is sectioned into the discharge spaces in the direction of the line electrodes or to form matrix discharge cells (partition walls in the form of a well curb) in the directions of the line and column electrodes.

The dielectric layer 15 covering the line electrode pairs 14 has a bulk raising portion 15*a* above and between the bus electrodes 13*a*, the bulk raising portion having a film thickness greater than the rest of it and protruding toward the discharge space. The bulk raising portion 15*a* is used for preventing the discharge induced between the line electrodes from scattering in the column direction and spreading out into the adjoining cells in the line direction, thus preventing error discharging.

The dielectric layer 15 is formed by screen printing using low-melting glass paste or transferring a low-melting glass layer in the form of a film for patterning, which is then subjected to calcination. Although the bulk raising portion 15*a*, of the dielectric, layer 15 is provided by patterning above the bus electrodes 13 and among the bus electrodes 13*a* in the display area of the panel, the bulk raising portion thereof is also formed uniformly by solid coating in a non-display area 32 outside the display area 31 excluding the peripheral portion where a sealing layer 23 is formed.

A method of producing the conventional plasma display panel 20 will be described below.

First, the component elements of the plasma display panel 20 including line electrode pairs 14, a dielectric layer 15, the bulk raising portion 15*a* of the dielectric layer 15 and an MgO layer 16 are successively formed on one side of the front substrate 11, whereas column electrodes 18, a column electrode protective layer 19, partition walls 21, phosphor layers 22 and the like are successively formed on one side of the back substrate 17.

Then there follows a sealing process including the steps of applying a sealing material of low-melting fritted glass 27 containing glass beads (granular substance) 28 by screen printing to the peripheral portion of the back substrate 17 and also applying a lead-in passage forming material of low-melting fritted glass 27 containing glass beads (granular substance) 28 so that a lead-in passage 41 for exhausting and introducing the discharge gas from and into an exhaust/lead-in port 25 provided in the end portion of the back, substrate 17.

After the formation of the sealing layer 23 and a lead-in rib 24 through tentative calcination, the front-substrate 11 and the back substrate 17 are stacked up and then final calcination is carried out while the end portions of both the substrates are fixed with clips. The sealing layer 23 is softened during the final calcination and fused, so that the space between both the substrates (the front substrate 11 and the back substrate 17) is sealed up.

Both the substrates are sealed up and then a chip pipe 26 is fixed to the exhaust/lead-in port 25 of the back substrate 17 with low-melting fritted glass 27 whereby to exhaust the air in the inner space between both the substrates via the chip pipe 26. Then the discharge gas containing neon and xenon gases is encapsulated in the inner space with a predetermined pressure, which is followed by fusion-sealing the chip pipe 26.

As the discharge gas is introduced from the exhaust/lead-in port 25 into the discharge spaces of the display area 31 via the lead-in passage 41 defined by the lead-in rib 24, any impurity gas is absorbed by the side wall of the lead-in rib 24 in the lead-in passage 41 and the MgO layer 16 of the front substrate 11 and prevented from flowing into the display area 31.

During the sealing process in the method of producing the plasma display panel, the bulk raising portion 15*a* of the dielectric layer 15 is formed on a portion opposite to the portion to which the lead-in passage forming material is applied rather than the portion to which the sealing material is applied.

Consequently, because the height of a lead-in rib 24 to be formed is made greater by the thickness (10 $\mu$m–12 $\mu$m) of the bulk raising portion 15*a* than that of the sealing layer 23, the space 42 between both the substrates (i.e., between the MgO layer 16 and the column electrode protective layer 19) is not uniformized in the display area 31 as shown in FIG. 2. Therefore, a gap 33 is produced between the partition wall 21 and the MgO layer 16.

Moreover, there has been a problem arising from being unable to obtain desired display characteristics as interference with the discharging of adjoining discharge cells via the gap 33 may develop error discharging.

The gap 33 may also be produced in case where the bulk raising portion 15*a* exists in a portion corresponding to the lead-in rib 24 even when the glass beads (granular substance) 28 are not contained in the fritted glass.

SUMMARY OF THE INVENTION

An object of the invention made to solve the foregoing problems is to provide a plasma display panel from which desired display characteristics and quality are obtained by uniformizing the space between both substrates in order to close the gap between a partition wall and an MgO layer.

To achieve the above object, a plasma display panel according to a first aspect of the invention comprises a front substrate and a back substrate facing each other with a discharge space held therebetween, the surrounding areas of the substrates being sealed up with a sealing layer, and partition walls for sectioning the discharge space in a display area into a plurality of discharge spaces, wherein an exhaust/lead-in port for exhausting and introducing discharge gas from and into the discharge spaces is provided in the outer peripheral non-display area of one of the front and back substrates and a lead-in rib for defining a lead-in passage from the exhaust/lead-in port is provided; and the dimension of the space between the front substrate and the back substrate in the portion provided with the sealing layer and the lead-in rib is uniformized.

The dimension of the space between both the substrates is thus uniformized in order to close the gap between the partition wall and an MgO layer and to prevent interference with the discharging of adjoining discharge cells, whereby error discharging is prevented from developing, so that desired display characteristics and quality are obtained.

In the plasma display panel according to a second aspect of the invention, display electrodes, each having a transparent electrode and a bus electrode laid on the transparent electrode, and a dielectric layer for covering the display electrodes are formed on the inner surface of the front substrate; the dielectric layer has a bulk raising portion formed with the surface of the dielectric layer protruded upward between and above the opposed bus electrodes; and the bulk raising portion is extended over the non-display area and provided on the dielectric layer excluding its portion opposite to the sealing layer and what is opposite to the lead-in rib in the non-display area.

Since the bulk raising portion is absent in the opposite-to-the-sealing-layer portion of the dielectric layer and the opposite-to-the-lead-in-rib portion thereof, the dimension of the space between both the substrates is thus uniformized in order to close the gap between the partition wall and the MgO layer and to prevent interference with the discharging of adjoining discharge cells, whereby error discharging is prevented from developing, so that desired display characteristics and quality are obtained.

In the plasma display panel according to a third aspect of the invention, the sealing layer contains granular substance having an external diameter substantially equal to the dimension of the space between the front substrate and the back substrate.

Thus, mixing the sealing layer and the granular substance whose external diameter is substantially equal to the dimension of the space between the front substrate and the back substrate makes it possible to prevent the space between both the substrates on the periphery of the sealing layer provided around the plasma display panel from being excessively collapsed.

In the plasma display panel according to a fourth aspect of the invention, the lead-in rib contains granular substance having an external diameter substantially equal to the dimension of the space between the front substrate and the back substrate.

Thus, mixing the lead-in rib and the granular substance whose external diameter is substantially equal to the dimension of the space between the front substrate and the back substrate makes it possible to prevent the space between both the substrates on the periphery of the lead-in rib from being excessively collapsed. Therefore, the lead-in passage for exhausting and introducing the discharge gas from and into the exhaust/lead-in port can be sized so that a predetermined amount of gas can pass therethrough.

DETAILED DESCRIPTION OF THE PREFERRED EMBODIMENTS

A detailed description will now be given of an embodiment of the invention by reference to the drawings, namely, FIGS. 1, 2 and 3.

Figure 1:
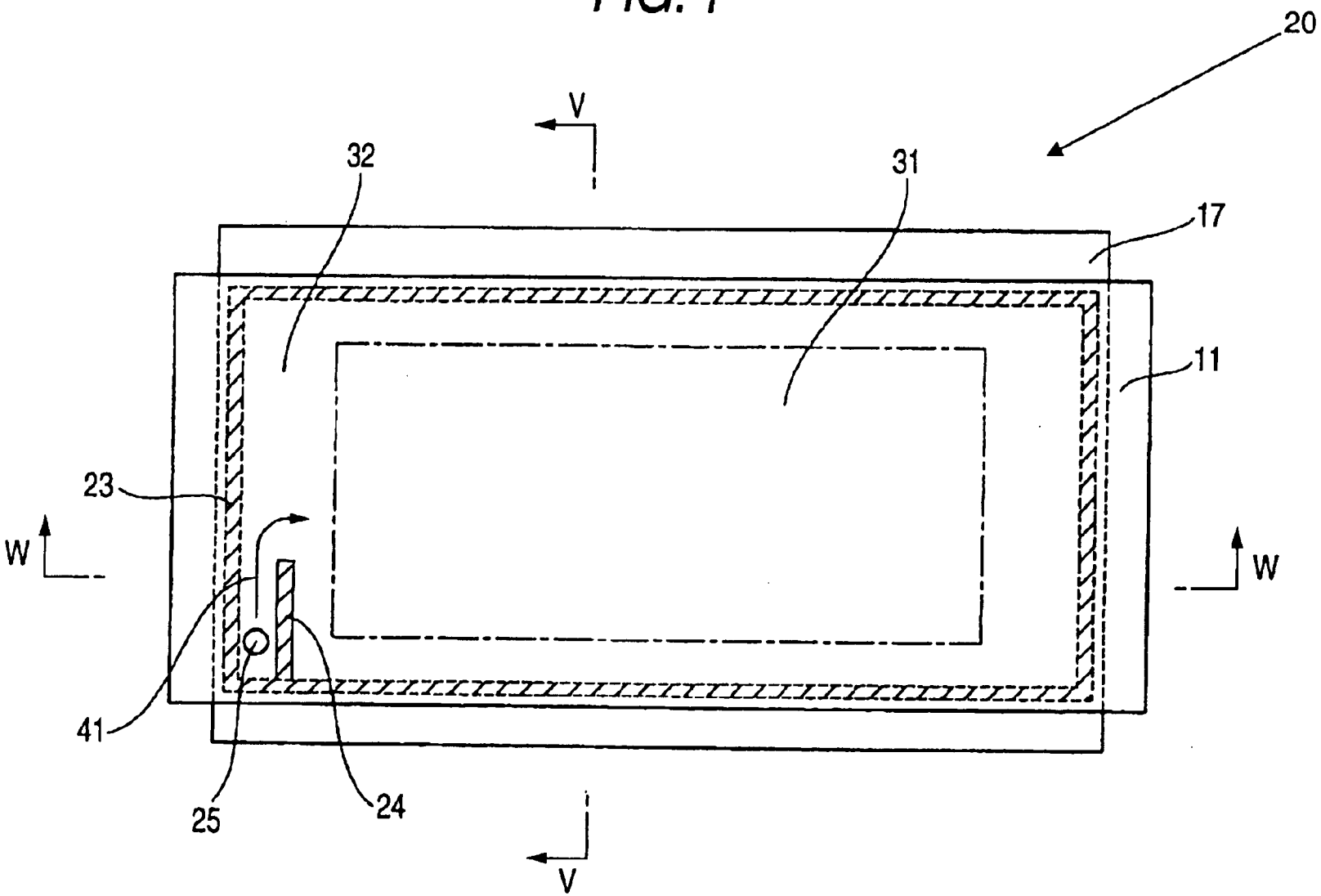
FIG. 1 is a plan view of a plasma display panel according to the invention and in the prior art.

FIG. 1 is a plan view of a plasma display panel; FIG. 2 is a partial sectional view depicting characteristic of a plasma display pane 10 according to this embodiment of the invention, the partial sectional view being taken on line W—W of FIG. 1; and FIG. 3 is a partial sectional view taken on line V—V of FIG. 1.

Figure 3:
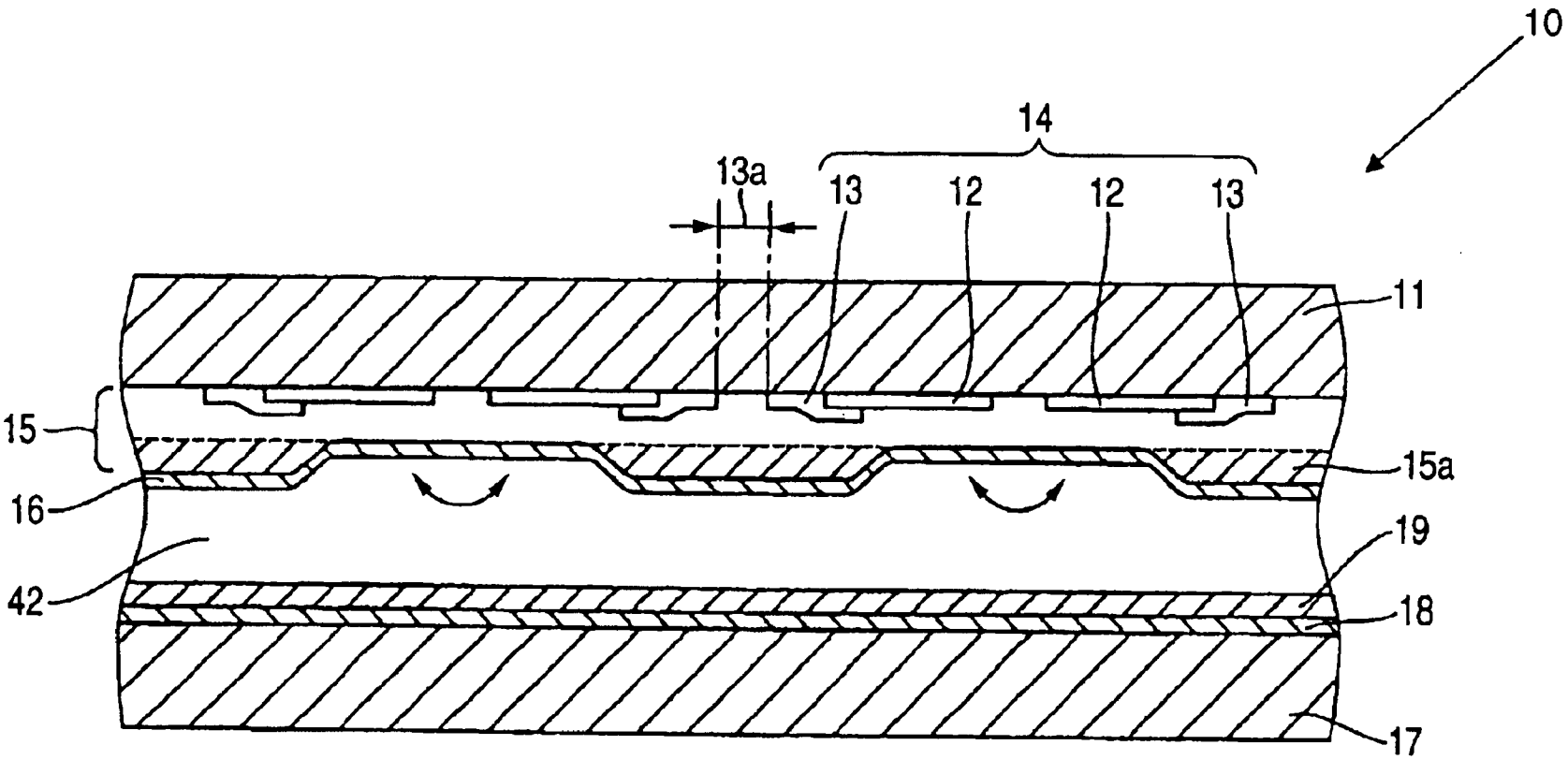
FIG. 3 is a partial sectional view taken on line V—V of FIG. 1.

The plasma display panel shown in FIGS. 1 and 3 are similar in construction to the conventional one and like functional elements are given like reference characters in each figure.

Figure 2:
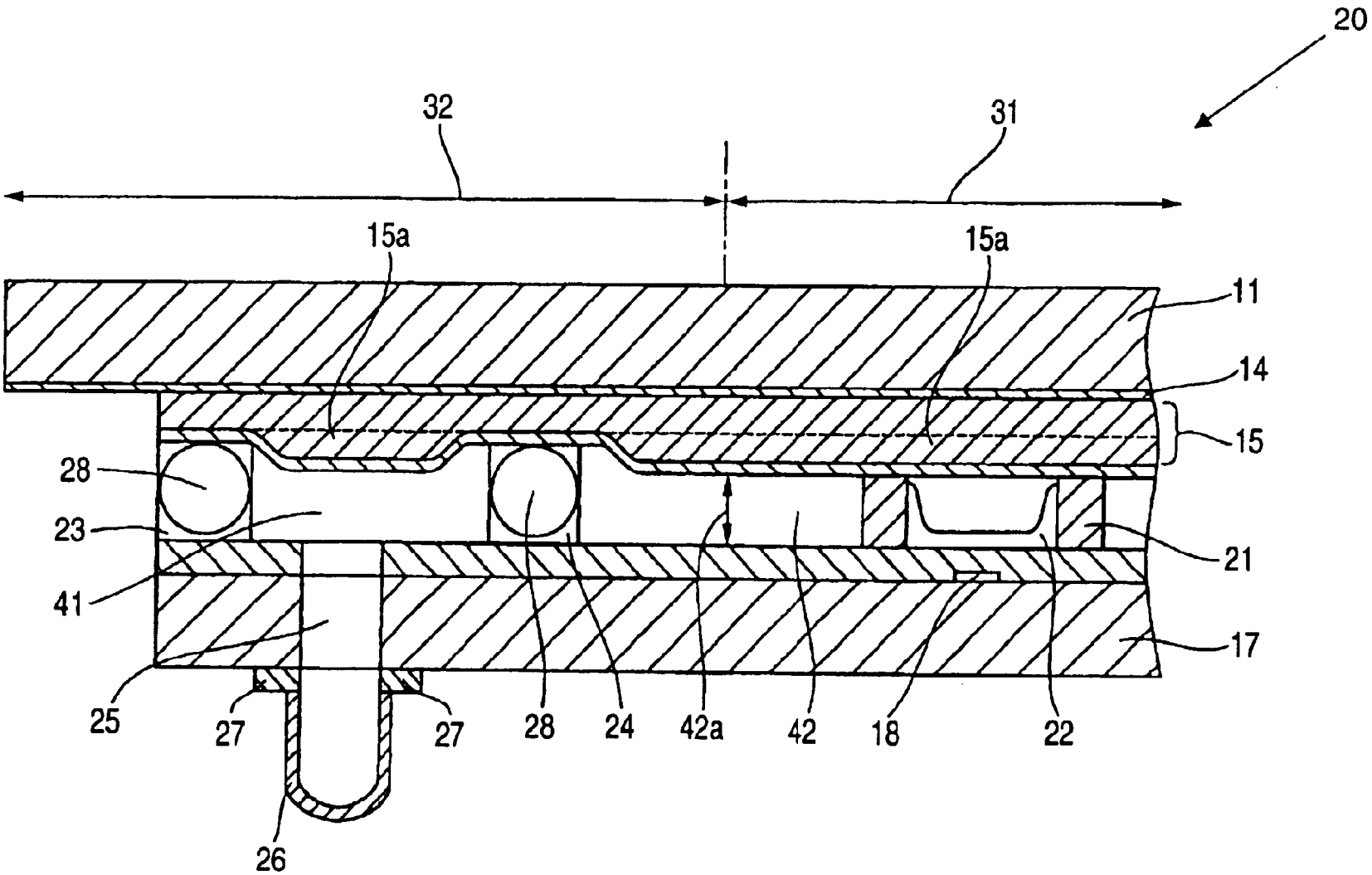
FIG. 2 is a partial sectional view of the plasma display panel according to the invention, the view being taken on line W—W of FIG. 1.

As shown in FIGS. 1, 2 and 3, the plasma display panel 10 according to this embodiment of the invention has transparent electrodes 12 laid on the inner surface of a front substrate 11 and narrow bus electrodes 13 laid on the respective transparent electrodes 12. Further, line electrode pairs (display electrodes) 14 forming display lines, a dielectric layer 15 for covering the line electrode pairs 14, and an MgO layer 16 are provided on the front substrate 11 in this order.

On the other hand, on the inner surface of a back substrate 17 facing the front substrate 11 via the discharge spaces lie column electrodes 18 as discharge cells formed in a direction perpendicular to the line electrode pairs 14 and in the intersecting portions with the respective line electrode pairs 14, a column electrode protective layer (white dielectric layer) 19 for covering the column electrodes 18, partition walls 21 for use in sectioning the space between the two substrates into the discharge spaces on a discharge cell basis, and phosphor layers 22 of R, G and B colors for covering the side wall of the column electrode protective layer 19 between the partition walls and the side wall of each partition wall 21.

A discharge gas containing neon and xenon gases is encapsulated in the discharge spaces. Each partition wall 21 is provided between the column electrodes to form striped partition walls 21 such that the space between the two substrates is sectioned into the discharge spaces in the direction of the line electrodes or to form matrix discharge cells (partition walls in the form of a well curb) in the directions of the line and column electrodes.

The dielectric layer 15 covering the line electrode pairs 14 has a bulk raising portion 15*a* above and between the bus electrodes 13, the bulk raising portion having a film thickness greater than the rest of it and protruding toward the discharge space. The bulk raising portions 15*a* are used for preventing the discharge induced between the line electrodes from scattering in the column direction and spreading out into the adjoining cells in the line direction, thus preventing error discharging.

The dielectric layer 15 is formed by screen printing using low-melting glass paste or transferring a low-melting glass layer in the form of a film for patterning, which is then subjected to calcination.

The plasma display panel 10 according to this embodiment of the invention is characterized in that, as shown in the sectional view of FIG. 2, in neither the portion of a dielectric layer 15*b* opposite to the portion where a lead-in rib 24 is formed nor the portion of a dielectric layer 15*c* opposite to the portion where a sealing layer 23 is formed, the bulk raising portion 15*a* is provided. However, the bulk raising portion 15*a* is provided (by solid coating) in any portion other than 15*b* and 15*c* of the dielectric layer 15 in a non-display are as in the case of the comparative example.

A method of producing the plasma display panel 10 according to this embodiment of the invention is similar to the above-described method of producing the conventional plasma display panel 20 except that in neither the portion of the dielectric layer 15*b* opposite to the portion where the lead-in rib 24 is formed nor the portion of the dielectric layer 15*c* opposite to the portion where the sealing layer 23 is formed, the bulk raising portion 15*a* is provided.

Since the bulk raising portion 15*a* is non-existent in not only the portion of the dielectric layer 15*c* opposite to the portion to which the sealing material is applied (sealing layer 23) but also the portion of the dielectric layer 15*b* opposite to the portion to which the lead-in passage forming material is applied (lead-in rib 24), the height (space dimension 42*a*) of the space 42 between both the substrates (between the MgO layer 16 and the column electrode protective layer 19) is substantially uniformized in the display and non-display areas at the time of application of the sealing material and the lead-in passage forming material, followed by stacking up both the substrates.

Figure 4:
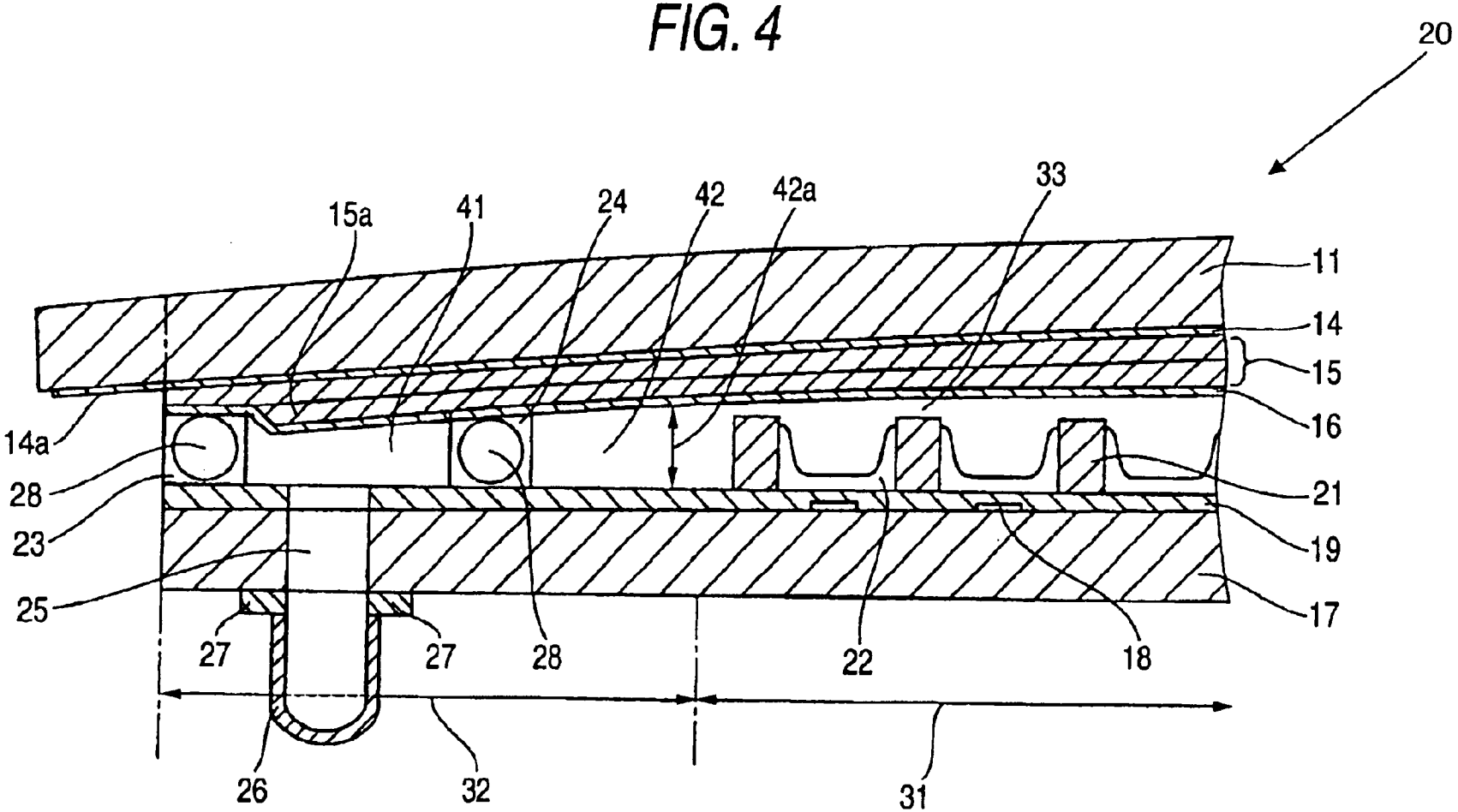
FIG. 4 is a partial sectional view of a conventional plasma display panel, the view being taken on line W—W of FIG. 1.

Thus, the space 42 between both the substrates can be made uniform at the time of calcination and as no gap 33 is produced between the front substrate 11 and the partition walls 21 of the back substrate 17 (see comparative example of FIG. 4) while interference with the discharging of adjoining discharge cells is preventable, error discharging never occurs, whereby desired display characteristics and quality are obtainable.

Moreover, mixing the sealing layer and glass beads (granular substance) 28 having predetermined size distribution makes it possible to prevent the space 42 between both the substrates in the periphery of the sealing layer 23 provided around the plasma display panel from being excessively collapsed. Since the space 42 between both the substrates in the periphery of the lead-in rib 24 can also be prevented from being excessively collapsed, a lead-in passage for exhausting and introducing the discharge gas from and into an exhaust/lead-in port can be sized so that a predetermined amount of gas can pass therethrough.

It is therefore preferred to use such glass beads (granular substance) 28 to be contained in the sealing material and the lead-in passage forming material as to have melting point higher than those of the sealing material and the lead-in passage forming material and an external diameter substantially equal to (or slightly greater than) the height (space dimension 42*a*) of the space 42 between both the substrates (between the MgO layer 16 and the column electrode protective layer 19).

As set forth above in detail, according to the first aspect of the invention, the dimension of the space between both the substrates is uniformized in order to close the gap between the partition wall and the MgO layer and to prevent interference with the discharging of adjoining discharge cells, whereby error discharging is prevented from developing, so that a plasma display panel allowing desired display characteristics and quality to be obtained can be provided.

According to the second aspect of the invention, since the bulk raising portion is absent in the opposite-to-the-sealing-layer portion of the dielectric layer and the opposite-to-the-lead-in-rib portion thereof, the dimension of the space between both the substrates is thus uniformized in order to close the gap between the partition wall and the MgO layer and to prevent interference with the discharging of adjoining discharge cells, whereby error discharging is prevented from developing, so that a plasma display panel allowing desired display characteristics and quality to be obtained can be provided.

According to the third aspect of the invention, mixing the sealing layer and the granular substance whose external diameter is substantially equal to the dimension of the space between the front substrate and the back substrate makes it possible to provide a plasma display panel capable of preventing the space between both the substrates on the periphery of the sealing layer provided around the plasma display panel from being excessively collapsed.

According to the fourth aspect of the invention, mixing the lead-in rib and the granular substance whose external diameter is substantially equal to the dimension of the space between the front substrate and the back substrate makes it possible to prevent the space between both the substrates on the periphery of the lead-in rib from being excessively collapsed. Therefore, the lead-in passage for exhausting and introducing the discharge gas from and into the exhaust/lead-in port can be sized so that a predetermined amount of gas can pass therethrough.

What is claimed is:

1. A plasma display panel, comprising:

front and back substrates facing each other with a discharge space held therebetween, the surrounding areas of the substrates being sealed up with a sealing layer;

partition walls for sectioning the discharge space in a display area into a plurality of discharge spaces;

an exhaust/lead-in port provided in an outer peripheral non-display area of one of the front and back substrates for exhausting and introducing discharge gas from and into the discharge spaces;

display electrodes, each having a transparent electrode and a bus electrode laid on the transparent electrode, a dielectric layer for covering the display electrodes, said display electrodes and said dielectric layer being formed on an inner surface of the front substrate, and a lead-in rib for defining a lead-in passage from the exhaust/lead-in port, wherein the dimension of the space between the front substrate and the back substrate in the portion provided with the sealing layer and the lead-in rib is uniformized, the dielectric layer has a bulk raisin a portion formed with the surface of the dielectric layer protruding upward between and above the opposed bus electrodes, and the bulk raising portion is extended over the non-display area and provided on the dielectric layer excluding its portion opposite to the sealing layer and what is opposite to the lead-in rib in the non-display area.

2. The plasma display panel as claimed in claim 1, wherein the sealing layer contains granular substance having an external diameter substantially equal to the dimension of the space between the front substrate and the back substrate.

3. The plasma display panel as claimed in claim 1, wherein the lead-in rib contains granular substance having an external diameter substantially equal to the dimension of the space between the front substrate and the back substrate.

4. A plasma display panel, comprising:

front and back substrates facing each other with a discharge space held therebetween, the surrounding areas of the substrates being sealed up with a sealing layer;

display electrodes, each having a transparent electrode and a bus electrode laid on the transparent electrode, and a dielectric layer for covering the display electrodes, said display electrodes and said dielectric layer being formed on an inner surface of the front substrate, wherein the dielectric layer has a bulk raising portion formed with the surface of the dielectric layer protruding upward between and above the opposed bus electrodes, and the bulk raising portion is extended over a non-display area and provided on the dielectric layer excluding its portion opposite to the sealing layer and what is opposite to a lead-in rib in the non-display area.

5. The plasma display panel of claim 4, wherein the lead-in rib contains granular substance having an external diameter substantially equal to the dimension of the space between the front substrate and the back substrate.

6. The plasma display panel of claim 4, wherein the sealing layer contains granular substance having an external diameter substantially equal to the dimension of the space between the front substrate and the back substrate.

7. The plasma display panel of claim 5, wherein the granular substance is glass beads.

8. The plasma display panel of claim 6, wherein the granular substance is glass beads.

9. The plasma display panel of claim 5, wherein the granular substance has a melting point higher than a sealing material used in the sealing layer and a lead-in material used to form the lead-in rib.

* * * * *